US005671113A

United States Patent [19]

Knepler

[11] Patent Number: 5,671,113

[45] Date of Patent: Sep. 23, 1997

[54] LOW WATER PROTECTOR

[75] Inventor: John T. Knepler, Chatham, Ill.

[73] Assignee: Bunn-O-Matic Corporation, Springfield, Ill.

[21] Appl. No.: 532,073

[22] Filed: Sep. 22, 1995

[51] Int. Cl.[6] ..... H02H 5/04

[52] U.S. Cl. ..... 361/103; 361/93; 361/115

[58] Field of Search ..... 361/103, 93, 115

[56] References Cited

U.S. PATENT DOCUMENTS

| | | | |
|---|---|---|---|
| 4,480,173 | 10/1984 | Butterfield | 219/312 |
| 4,917,005 | 4/1990 | Knepler | 99/280 |
| 4,978,833 | 12/1990 | Knepler | 392/449 |
| 5,019,690 | 5/1991 | Knepler | 219/400 |

*Primary Examiner*—Jeffrey A. Gaffin
*Assistant Examiner*—Stephen Jackson
*Attorney, Agent, or Firm*—Trexler, Bushnell, Giangiorgi & Blackstone, Ltd.

[57] ABSTRACT

A protection circuit for use with a hot water dispensing apparatus of the type which includes a reservoir and a heating element coupled to the reservoir for heating water retained therein. The protection circuit includes a conductivity detector coupled to the reservoir for detecting a desired quantity of water in the reservoir. A first sensor and a second sensor of the conductivity detector are coupled to the reservoir at spaced apart locations. A conductivity detector circuit is coupled to the first and second sensors and coupled to a control circuit of the hot water dispensing apparatus for preventing operation of the apparatus until a desired quantity of water is disposed in the reservoir.

4 Claims, 2 Drawing Sheets

LOW WATER PROTECTOR

BACKGROUND

The present invention relates to a hot water dispensing apparatus such as a beverage brewing apparatus. More particularly, the present invention is directed to a protection circuit for use with, or in combination with, a hot water dispensing apparatus.

It is desirable for restaurants and other commercial cooking establishments to have a source of hot water for various cooking purposes, as well as for various cleaning purposes. To supply hot water for these and other purposes, hot water dispensers have come to increasing use. Typically, such apparatus employ a hot dispensers have come to increasing use. Typically, such apparatus employ a hot water reservoir in which water is heated by an electric resistance heating element. The application of electric current to the heating element is controlled by various means responsive to the temperature of the water in the reservoir, such as a thermostat, to achieve a predetermined dispensing temperature.

Additionally, various coffee brewers have been developed which include a reservoir in which water is heated to a predetermined brewing temperature and subsequently dispensed. In such an apparatus, heated water may be displaced from an upper portion or outlet zone of the reservoir by cold water which is introduced into the bottom portion or inlet zone of the reservoir. The displaced heated water is discharged onto ground coffee or through a faucet for use consistent with the description of the hot water dispenser described above.

During the installation, repair or maintenance of such hot water dispensing apparatus, it may be necessary to assemble or disengage the heating element. One of the problems which arises during such installation, repair or maintenance is that the heating element needs to be immersed in water to prevent damage once the heating element is energized. For example, when installing such a hot water dispensing apparatus, if the installer activates the heating element before filling the tank, the heating element may damage the circuit, thereby requiring replacement of the circuit, heater, or both. If the installer had filled the water prior to energizing the heating element, the heating element would have operated to heat the water until the thermostat, signalling the control circuit, deactivates it.

Another way in which damage can occur is if the water level in the reservoir drops below a desired level, or if for some reason the water is drained from the reservoir. More specifically, the water supply could be interrupted by shutting off the main to the facility in which the hot water dispensing apparatus resides, or by damage to the line supplying the reservoir. Many of these apparatus include a water level control which is coupled to the control circuit to automatically introduce water by way of a solenoid valve which is also coupled to the control circuit. However, if the solenoid valve is damaged or prevented from operating, the control circuit cannot introduce additional water. In the event that water in the reservoir is drawn off or evaporated, the heating element may overheat and damage the control circuit by exposure to the ambient air.

OBJECTS AND SUMMARY

A general object satisfied by the claimed invention is to provide a protection circuit which is coupled to a hot water dispensing apparatus for preventing operation of a heating element when the reservoir does not have sufficient water therein for proper operation of the device.

A further object satisfied by the present invention is to provide a protection circuit which prevents energizing the heating element during the installation of a heated water device until after the reservoir is charged with water to a desired level.

Still a further object satisfied by the present invention is to provide a protection circuit which can be added to an existing hot water dispensing apparatus provided by the benefits as described herein.

Briefly, and in accordance with the foregoing, the present invention envisions a protection circuit for use with a hot water dispensing apparatus of the type which includes a reservoir and a heating element coupled to the reservoir for heating water retained therein. The protection circuit includes a conductivity detector coupled to the reservoir for detecting a desired quantity of water in the reservoir. A first sensor and a second sensor of the conductivity detector are coupled to the reservoir at spaced apart locations. A conductivity detector circuit is coupled to the first and second sensors and coupled to a control circuit of the hot water dispensing apparatus for preventing operation of the apparatus until a desired quantity of water is disposed in the reservoir.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 1:
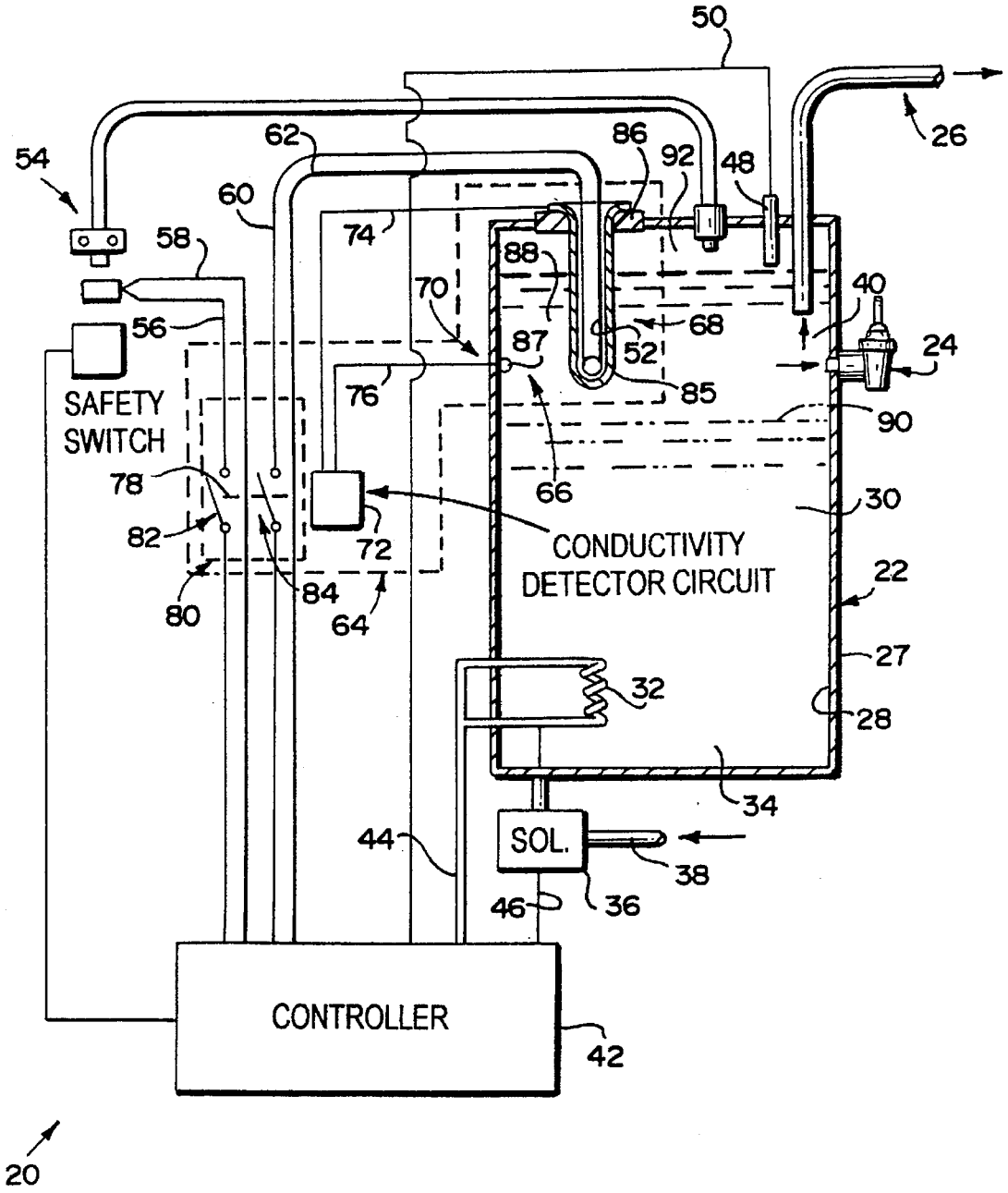
FIG. 1 is a simplified diagrammatic illustration, in partial schematic form, showing the principal components of the hot water dispensing apparatus and protection circuit.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

FIG. 1 shows a diagrammatic form of a hot water dispensing apparatus or heated water device 20 which may be used to produce heated water in a reservoir 22 for dispensing from a faucet 24 or through a dispensing line 26 to a beverage brewing device (not shown). The reservoir 22 has a housing 27 defining a chamber 28 in which water 30 is retained. The water 30 is heated by a heating element or heater 32 which is generally positioned in an inlet zone or lower portion 34 of the reservoir 22. Water enters the chamber 28 in the inlet zone 34 through a controllable valve 36 which is coupled to a water supply line 38. Water in the supply line 38 passes through the controllable valve 36 and is dispensed into the lower portion 34 of the reservoir 22. The water flowing through the supply line 38 is cooler than the heated water retained in the reservoir and, therefore, tends to remain in the lower section 34. As water is heated by the heater 32, convection flow tends to cause higher temperature water to rise to an outlet zone or upper portion 40 of the reservoir 22.

A control circuit 42 is provided with the heated water device 20 to control the heater 32 over control line 44 and to control the controllable valve 36 over the control line 46. Several sensing devices provide information to the control circuit 42. The control circuit 42 provides an appropriate response to the information by way of controlling the heater 32 or control valve 36. For example, a water level sensor 48 is provided in the upper portion 40 of the reservoir 22 to detect a desired water level. The water level sensor 48 is of known construction and provides a signal over control line 50 to the control circuit 42. A pair of heat-detecting sensors 52, 54 are provided to sense the temperature of the water 30 retained in the reservoir 22. One of the sensors, in the form of a temperature probe 52, extends into the water 30 in the chamber 28 to sense the temperature of the water. The temperature probe 52 is a thermocouple device of known construction. The temperature sensor 52 is connected to the control circuit 42 over control lines 56, 58. The other sensor, in the form of a steam sensor 54, is of a known construction as set forth in U.S. Pat. No. 5,019,690 to Knepler, assigned to the assignee of the present invention and which is incorporated herein by reference.

The level sensor 48 detects the level of water in the chamber 28 of the reservoir 22. When the water level falls below a desirable predetermined level, the control circuit 42 operates the controllable valve 36 over control line 46. The controllable valve 36 is a solenoid valve of known construction. In a similar manner, the temperature probe 52 senses the temperature of the water 30 in the chamber 28. When the temperature of the water falls below a desirable level, the control circuit 42 activates the heater 32 over the control line 44 to increase the temperature of the water 30. The steam sensor 54 monitors the steam output of the chamber 28 and provides a signal over control lines 60, 62. The steam sensor 54 provides additional temperature information to the control circuit 42 which may be incorporated in the control circuit logic for operating the heater 32. The details of the operation of the steam sensor 54 are taught and are incorporated herein by reference to Knepler '690.

The present invention includes a protection circuit 64 which is coupled to the heated water device described hereinabove. The protection circuit 64 is coupled to the control lines 56,58 of the temperature sensor 52 and to the control lines 60,62 of the steam sensor 54. The protection circuit 64 includes a conductivity detector 66 which includes a first sensor 68 positioned in the chamber 28 of the reservoir 22 and a second sensor 70 positioned at a spaced apart location relative to the first sensor 68. The conductivity detector 66 also includes a conductivity detector circuit 72 which is coupled to the first sensor 68 by line 74 and is coupled to the second sensor 70 by line 76. A control line 78 of the conductivity detector circuit 72 is coupled to a relay switch 80 which includes a pair of switches 82,84 coupled to the control lines 60,56, respectively.

The first sensor 68 is a conductive sleeve 85 which extends into the water 30. The conductive sleeve 85 is retained on the reservoir 22 by a nonconductive rim or gasket 86. The line 74 is connected to the sleeve 85 in which the temperature probe 52 is retained. The sleeve 85 and probe 52 are insulated from each other with the probe 52 sensing the temperature of the water through the sleeve 85. The second sensor 70 is in the form of a contact 87 connected directly to the housing 27 of the reservoir 22. When the reservoir housing 27 is a metallic conductive material, the second sensor 70 or contact 87 may be directly connected to the housing 27. Alternatively, if the housing 27 is formed with a plastic material, the contact 87 of the sensor 70 may be a probe which extends through the housing 27 to provide a conductive contact with the water 30.

A conductive circuit is established in a gap 88 between the sleeve 85 and the contact 87. When the water level (as indicated by water level 90) is below the sleeve 85 and the contact 87, there is no conductivity between the sleeve 85 and the contact 87. In this condition, the conductivity detector circuit 72 coupled to the sleeve 85 by line 74 and to the contact 87 by line 76 senses no conductivity and therefore indicates a low water condition. In the low water condition, the conductivity detector circuit 72 operates the relay 80 to open the switches 82,84 creating an open circuit in the steam sensor 54 and the temperature detector 52. When these circuits 52,54 are open, the control circuit 42 recognizes this as a low water condition and deactivates the heater 32.

When the water is at a desired level (as indicated by water level 92), the water will close the circuit by conducting through the gap 88 between the sleeve 85 and the contact 87. In this condition, the conductivity will be sensed by the conductivity detector circuit 72 which will control the relay 80 over line 78 to close the switches 82,84 thereby indicating a desired water level condition. The control circuit 42 will then operate the heater 32 over line 44 to heat the water as described hereinabove.

Figure 2:
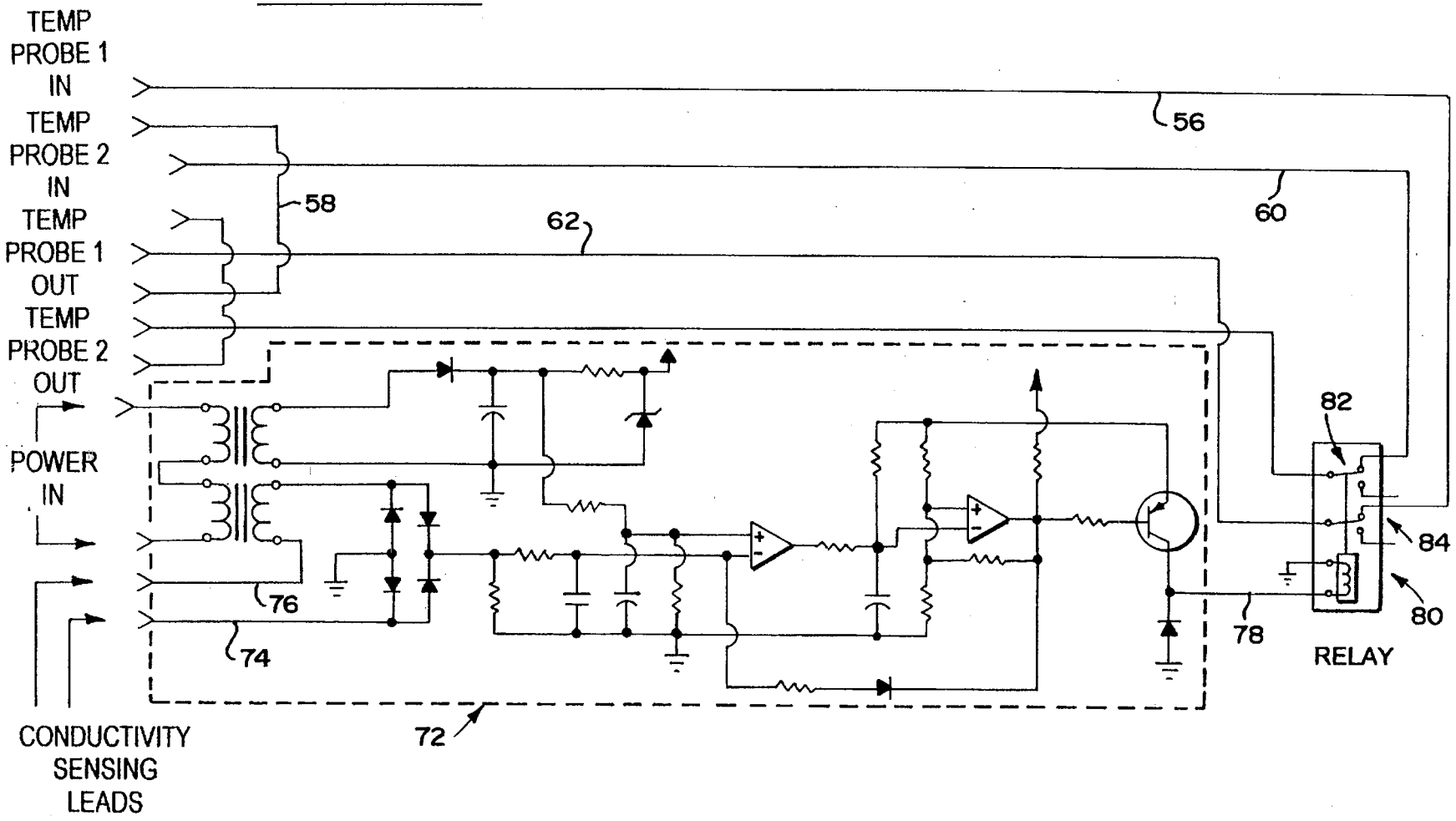
FIG. 2 is a simplified schematic diagram of the protection circuit utilized in the hot water dispensing apparatus of the present invention.

FIG. 2 shows a more detailed schematic of the present invention in which circuit details of the conductivity detector circuit 72 have been provided. The sensing leads 74,76 provide conductivity signal into the circuit 72 with a resulting control signal 78 being coupled to the relay 80.

In use, the protection circuit 64 of the present invention is employed to simplify the installation, repair and/or maintenance of a heated water device 20 by preventing operation of the heater 32 when the water level in the chamber 28 of the reservoir 22 is below a desired level. The protection circuit 64 includes the first and second sensors 68,70 which are spaced apart and are coupled to the conductivity detector circuit 72 to sense conductivity through water in the reservoir 22. When water contacts both the sleeve 85 and the contact 87 conductivity is sensed in the gap 88 between the sleeve 85 and the contact 87. When conductivity is detected, it is safe to energize the heater 32. The protection circuit 64 of the present invention may be used in the initial installation of a water heating device 20 or may be retro fitted into existing devices by employing a conductive sleeve 85 to house the temperature sensor probe 52 and connecting the sleeve 85 to the conductivity detector circuit 72 by line 74. The second sensor is attached to the reservoir 22 in accordance with the foregoing description and connected to the conductivity detector circuit 72 by line 76. The relay 80 is attached to the lines 60,56 to provide controllable open and closed circuits by operation of the switches 82,84. The protection circuit 64 provides a switch which does not require manual activation by a user but rather, operates to switch on the device 20 when water is present in the reservoir 22 or switch off the device 20 when water is not present in the reservoir 22.

It can be seen that the protection circuit 64 of the present invention greatly improves the reliability of the device 20 by preventing undesirable operation of the heater 32 when water is not present. This also provides a safety feature in the event that the water level in the tank drops below a desired level. The protection circuit 64 of the present invention is also important in the initial installation or startup of the device 20 such that when an installer assembles a device and supplies power to the device, the heater 32 will not be activated until there is sufficient water in the reservoir 22. When the sufficient water level has been achieved, the control circuit 42 automatically operates the heater 32 to heat the water 30. The water level sensor is positioned above the conductive path of the gap 88 in order to provide a means for maintaining a desired water level 92. Generally, the water level sensor 48 will detect a drop in water level thereby resulting in the control circuit 42 activating the control valve 36 to admit water from the supply line 38 into the lower portion 34 of the reservoir 22. In this regard, a normally functioning device 20 senses a drop in water level before the conductivity path 88 between the sleeve 85 and the contact 87 is broken.

While a preferred embodiment of the present invention is shown and described, it is envisioned that those skilled in the art may devise various modifications and equivalents without departing from the spirit and scope of the appended claims. The invention is not intended to be limited by the foregoing disclosure.

The invention claimed is:

1. A protection circuit for use with a heated water device having a heated water reservoir defining a chamber therein, a water heater coupled to said reservoir for heating water retained therein, said water heater being positioned in a lower section of said reservoir, and a control circuit coupled to said water heater, said protection circuit comprising:

a conductivity detector coupled to said reservoir for detecting a desired level of water in said reservoir;

a conductive sleeve of said conductivity detector extending downwardly into an upper portion of said reservoir and being vertically spaced away from said water heater, said sleeve being thermally conductive and electrically conductive for electrical conduction through water disposed in said chamber of said reservoir when said water contacts said sleeve;

a temperature sensor positioned in said conductive sleeve for sensing the temperature of said water retained in said chamber of said reservoir, a conductive sensor of said conductivity detector positioned at a spaced apart location relative to said conductive sleeve; and a conductivity detector circuit, said conductive sleeve and said conductive sensor being coupled to said conductivity detector circuit, said conductivity circuit including a relay coupled to said temperature sensor for automatically controlling said water heater by opening or closing the circuit of said temperature sensor for preventing said temperature sensor from sensing a selected condition and thereby preventing the operation of said water heater.

2. A protection circuit in combination with a heated water device as recited in claim 1, said first sensor comprising a sensor contact disposed in said reservoir at a selected position, said reservoir having walls being conductive defining said second sensor, said sensor contact being spaced from said reservoir walls for detecting conductivity therebetween.

3. A protection circuit in combination with a heated water device as recited in claim 1, said first sensor comprising a sensor contact disposed in said reservoir at a selected position, said reservoir having walls having at least one conductive portion defining said second sensor, said sensor contact and said conductive portion being spaced apart for detecting conductivity therebetween.

4. A protection circuit in combination with a heated water device as recited in claim 1, said first sensor comprising a sensor contact disposed in said reservoir at a selected position, said second sensor being attached to said reservoir for contacting the contents of said reservoir, said sensor contact and said second sensor being spaced apart for detecting conductivity therebetween.

* * * * *